US012790964B2

(12) United States Patent
Tabata et al.

(10) Patent No.: US 12,790,964 B2
(45) Date of Patent: Nov. 10, 2026

(54) STEAM TURBINE SYSTEM

(71) Applicant: MITSUBISHI HEAVY INDUSTRIES, LTD., Tokyo (JP)

(72) Inventors: Soichiro Tabata, Tokyo (JP); Masaomi Makino, Tokyo (JP); Shigeki Senoo, Tokyo (JP); Satoshi Miyake, Tokyo (JP); Kiyoshi Tatsuhara, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/837,767

(22) PCT Filed: Feb. 7, 2023

(86) PCT No.: PCT/JP2023/003902
§ 371 (c)(1),
(2) Date: Aug. 12, 2024

(87) PCT Pub. No.: WO2023/157708
PCT Pub. Date: Aug. 24, 2023

(65) Prior Publication Data

US 2025/0154883 A1 May 15, 2025

(30) Foreign Application Priority Data

Feb. 18, 2022 (JP) ..... 2022-023361

(51) Int. Cl.
*F01K 7/22* (2006.01)
*F01K 13/00* (2006.01)

(52) U.S. Cl.
CPC ..... *F01K 7/226* (2013.01); *F01K 13/00* (2013.01)

(58) Field of Classification Search
CPC ... F01K 7/226; F01K 7/22; F01K 7/16; F01K 13/00; F01K 13/02; F01K 13/006;
(Continued)

(56) References Cited

U.S. PATENT DOCUMENTS 6,910,335 B2 * 6/2005 Viteri ..... F23L 7/005 60/656
11,300,011 B1 * 4/2022 Feher ..... F01K 23/106
(Continued)

FOREIGN PATENT DOCUMENTS

JP 2003-074311 A 3/2003
JP 2004-308522 A 11/2004
(Continued)

OTHER PUBLICATIONS

International Search Report dated May 9, 2023, issued in counterpart Application No. PCT/JP2023/003902. (13 pages).
(Continued)

*Primary Examiner* — Dapinder Singh
(74) *Attorney, Agent, or Firm* — WHDA, LLP

(57) ABSTRACT

The steam turbine system according to at least one embodiment of this disclosure comprises: a steam turbine; a main steam supply line which supplies steam to an upstream stage of the steam turbine; an intermediate-stage steam supply line which supplies the steam to an intermediate stage downstream of the upstream stage of the steam turbine; and an agent injection device which injects, into the intermediate-stage steam supply line, an agent for modifying the steam.

8 Claims, 9 Drawing Sheets

(58) Field of Classification Search
CPC ..... F01K 23/10; F01K 11/02; F01D 9/065; F01D 25/00; F05D 2300/514; F05D 2220/31; F22D 1/36
See application file for complete search history.

(56) References Cited

U.S. PATENT DOCUMENTS

| | | | | |
|---|---|---|---|---|
| 2006/0010869 | A1* | 1/2006 | Blangetti | F28B 9/10 60/646 |
| 2017/0211414 | A1* | 7/2017 | Fujimura | B08B 9/032 |
| 2017/0362955 | A1* | 12/2017 | Fujimura | F01K 7/165 |
| 2019/0390577 | A1 | 12/2019 | Tanimura et al. | |
| 2020/0165971 | A1* | 5/2020 | Uechi | F01K 7/18 |
| 2021/0095572 | A1* | 4/2021 | Fujimura | F01K 23/101 |
| 2022/0325639 | A1* | 10/2022 | Drouvot | F01K 23/06 |

FOREIGN PATENT DOCUMENTS

| | | | |
|---|---|---|---|
| JP | 2005-042732 | A | 2/2005 |
| JP | 2008-164208 | A | 7/2008 |
| JP | 2017-160842 | A | 9/2017 |
| JP | 2019-044678 | A | 3/2019 |
| JP | 2019-190428 | A | 10/2019 |
| JP | 2020-003090 | A | 1/2020 |
| JP | 2020-029977 | A | 2/2020 |
| WO | 2018/143310 | A1 | 8/2018 |

OTHER PUBLICATIONS

Notification Concerning Transmittal of International Preliminary Report on Patentability (Forms PCT/IB/326) issued in counterpart International Application No. PCT/JP2023/003902 mailed Aug. 29, 2024, with Forms PCT/IB/373, PCT/IB/338 and PCT/ISA/237. (17 pages).

Office Action dated Aug. 26, 2025, issued in counterpart JP Application No. 2024-501306, with English translation. (6 pages).

Office Action dated Feb. 3, 2026, issued in counterpart JP Application No. 2024-501306, with English translation. (6 pages).

* cited by examiner

STEAM TURBINE SYSTEM

TECHNICAL FIELD

The present disclosure relates to a steam turbine system.

The present application claims priority based on Japanese Patent Application No. 2022-023361 filed in Japan on Feb. 18, 2022, the contents of which are incorporated herein by reference.

BACKGROUND ART

For example, in a combined cycle plant including a gas turbine and a steam turbine, a heat recovery steam generator may be connected to effectively utilize heat of an exhaust gas exhausted from the gas turbine (for example, refer to PTL 1).

The plant described in PTL 1 includes a waste heat recovery device as the heat recovery steam generator for effectively utilizing the heat of the exhaust gas. This waste heat recovery device has a superheater, an evaporator, and an economizer. In the waste heat recovery device, the high-temperature exhaust gas is supplied in this order to the superheater, the evaporator, and the economizer, and thus high-temperature and high-pressure steam is generated by utilizing the heat of the exhaust gas and is supplied to the steam turbine.

CITATION LIST

Patent Literature

[PTL 1] Japanese Unexamined Patent Application Publication No. 2020-003090

SUMMARY OF INVENTION

Technical Problem

In order to further effectively utilize the heat of the exhaust gas, further improvement in efficiency of the steam turbine system is required.

At least one embodiment of the present disclosure is made in view of the above-described circumstances, and an object thereof is to further improve the efficiency of a steam turbine system.

Solution to Problem

A steam turbine system according to at least one embodiment of the present disclosure includes a steam turbine, a main steam supply line for supplying steam to a most upstream stage of the steam turbine, an intermediate-stage steam supply line for supplying steam to an intermediate stage that is downstream of the most upstream stage of the steam turbine, and a chemical injection device for injecting a chemical for reforming steam into the intermediate-stage steam supply line.

Advantageous Effects of Invention

According to at least one embodiment of the present disclosure, it is possible to further improve the efficiency of a steam turbine system.

DESCRIPTION OF EMBODIMENTS

Figure 1:
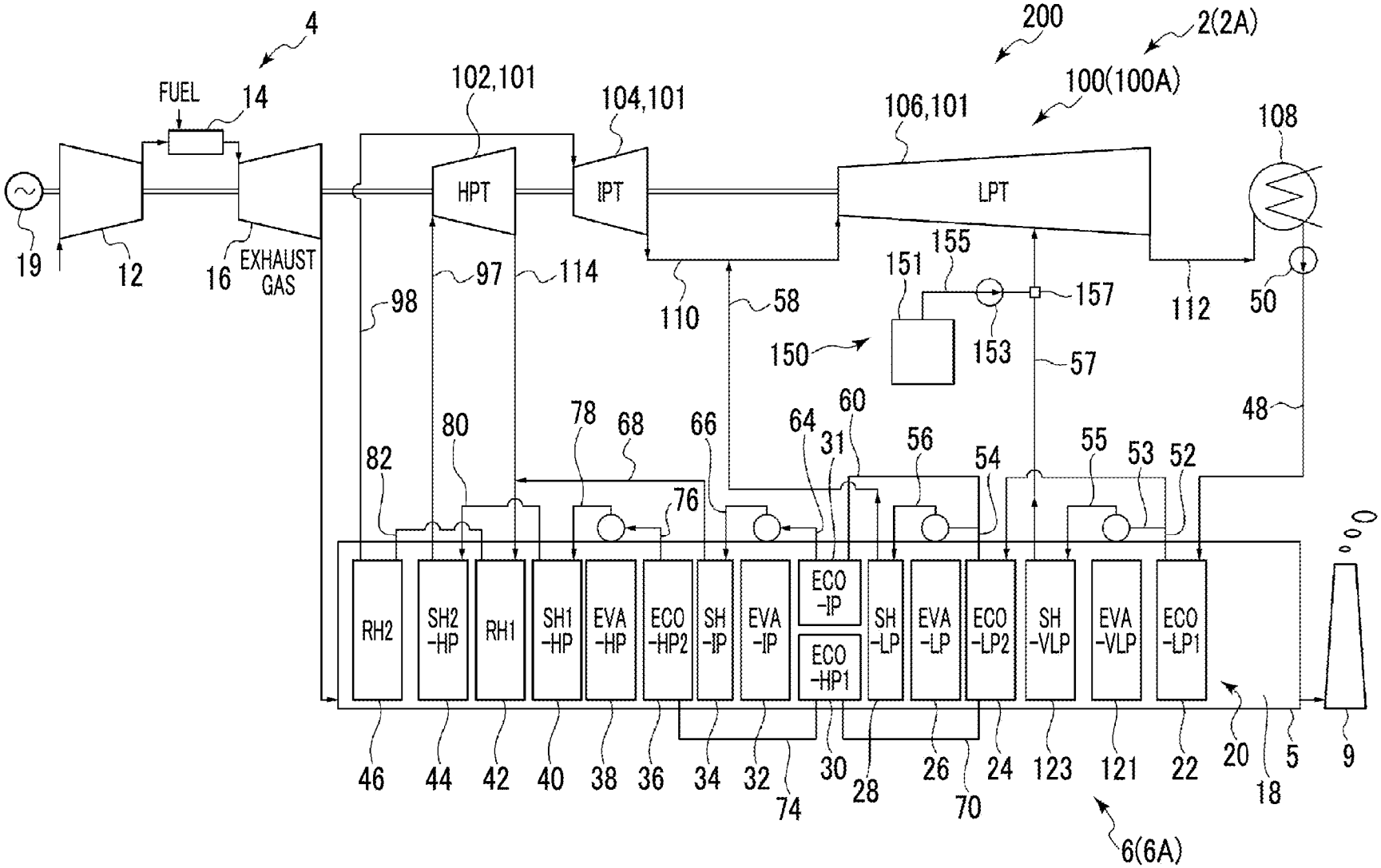
FIG. 1 is a diagram showing a schematic overall configuration of a combined plant according to one embodiment.

Hereinafter, some embodiments of the present disclosure will be described with reference to the accompanying drawings. Dimensions, materials, shapes, relative arrangements, and the like of components described as embodiments or illustrated in the drawings are not intended to limit the scope of the present disclosure, but are merely explanatory examples.

For example, an expression representing a relative or absolute arrangement such as "in a certain direction", "along a certain direction", "parallel", "orthogonal", "center", "concentric", or "coaxial" does not strictly represent only such an arrangement, but also a tolerance or a state of being relatively displaced with an angle or a distance to the extent that the same function can be obtained.

For example, an expression such as "identical", "equal", or "homogeneous" representing a state where things are equal to each other does not strictly represent only the equal state, but also a tolerance or a state where there is a difference to the extent that the same function can be obtained.

For example, an expression representing a shape such as a quadrangular shape or a cylindrical shape does not represent only a shape such as a quadrangular shape or a cylindrical shape in a geometrically strict sense, but also a shape including an uneven portion, a chamfered portion, and the like within a range in which the same effect can be obtained.

Meanwhile, the expressions "being provided with", "comprising", "including", or "having" one component are not exclusive expressions excluding the presence of other components.

Configuration of Combined Plant

FIG. 1 is a diagram showing a schematic overall configuration of a combined plant 2 (2A) according to one embodiment.

The combined plant 2 includes a gas turbine 4 as a prime mover, a steam turbine system 100, a heat recovery steam generator 5 as a steam generator that generates steam, and a chimney 9 that releases exhaust gas discharged from the heat recovery steam generator 5 to the atmosphere. The steam turbine system 100 functions as a steam utilization facility that utilizes the steam generated by the heat recovery steam generator 5. In addition, the heat recovery steam generator 5 and the steam turbine system 100 configure a heat recovery plant 200 for recovering waste heat of the gas turbine 4.

Configuration of Gas Turbine

The gas turbine 4 includes a compressor 12 that compresses air, a combustor 14 that combusts fuel by using compressed air generated by the compressor 12, and a turbine 16 that is driven by combustion gas generated by the combustor 14. In the shown embodiment, a generator 19 is disposed on the same axis line as the compressor 12 and the turbine 16, and is configured such that each rotor of the compressor 12, the turbine 16, and the generator 19 rotates integrally.

Configuration of Steam Turbine System

The steam turbine system 100 (100A) according to one embodiment includes a plurality of steam turbines 101, a condenser 108 that cools steam discharged from a steam turbine 101 located at a most downstream side and that converts the steam back to water, and a chemical injection device 150. The steam turbine system 100 includes a high-pressure steam turbine 102, medium-pressure steam turbine 104, and a low-pressure steam turbine 106 as the plurality of steam turbines 101. A steam outlet of the medium-pressure steam turbine 104 and a steam inlet of the low-pressure steam turbine 106 are connected to each other via a medium-pressure exhaust line 110, and a steam outlet of the low-pressure steam turbine 106 and the condenser 108 are connected to each other via a low-pressure exhaust line 112. In the shown embodiment, the compressor 12, the turbine 16, the generator 19, the high-pressure steam turbine 102, the medium-pressure steam turbine 104, and the low-pressure steam turbine 106 are disposed on the same axis line, and are configured such that each rotor thereof rotates integrally.

Configuration of Heat Recovery Steam Generator

The heat recovery steam generator 5 includes an exhaust gas flow path 18 (heat medium flow path) through which the exhaust gas of the gas turbine 4 flows, and a plurality of heat exchangers 20 provided in the exhaust gas flow path 18. The plurality of heat exchangers 20 include a first low-pressure economizer 22 (first economizer), a super low-pressure evaporator 121 (second evaporator), a super low-pressure superheater 123 (second superheater), a second low-pressure economizer 24 (second economizer), a low-pressure evaporator 26 (first evaporator), a low-pressure superheater 28 (first superheater), first high-pressure economizer 30, medium-pressure evaporator 32, a medium-pressure superheater 34, a second high-pressure economizer 36, a high-pressure evaporator 38, a first high-pressure superheater 40, a first reheater 42, a second high-pressure superheater 44, and a second reheater 46 in this order from the downstream side in a flow direction of the exhaust gas in the exhaust gas flow path 18. A medium-pressure economizer 31 is provided to be parallel with the first high-pressure economizer 30 between the low-pressure superheater 28 and the medium-pressure evaporator 32 in the exhaust gas flow path 18.

The condenser 108 and the first low-pressure economizer 22 are connected to each other by a supply water line 48, and the supply water line 48 is provided with a condensate pump 50 for supplying a condensate discharged from the condenser 108 to the first low-pressure economizer 22.

The first low-pressure economizer 22 heats the water supplied from the supply water line 48 by exchanging heat with the exhaust gas. A part of the water heated by the first low-pressure economizer 22 is supplied to the second low-pressure economizer 24 via a supply water line 52 connecting the first low-pressure economizer 22 and the second low-pressure economizer 24.

A supply water line 53 provided to branch from the supply water line 52 is connected to the super low-pressure evaporator 121, and a part of the water heated by the first low-pressure economizer 22 is supplied to the super low-pressure evaporator 121 via the supply water line 53.

The super low-pressure evaporator 121 heats and evaporates the water supplied from the first low-pressure economizer 22 via the supply water line 53 by exchanging heat with the exhaust gas to generate super low-pressure steam. The super low-pressure steam generated by the super low-pressure evaporator 121 is supplied to the super low-pressure superheater 123 via a steam line 55 connecting the super low-pressure evaporator 121 and the super low-pressure superheater 123.

The super low-pressure superheater 123 superheats the super low-pressure steam supplied from the super low-pressure evaporator 121 via the steam line 55 by exchanging heat with the exhaust gas to generate the super low-pressure superheated steam. The super low-pressure superheated steam generated by the super low-pressure superheater 123 is supplied to an intermediate stage of the low-pressure steam turbine 106 via a low-pressure intermediate-stage steam supply line 57 (intermediate-stage steam supply line) connecting the super low-pressure superheater 123 and the intermediate stage of the low-pressure steam turbine 106.

The second low-pressure economizer 24 heats the water supplied from the first low-pressure economizer 22 via the supply water line 52 by exchanging heat with the exhaust gas. A part of the water heated by the second low-pressure economizer 24 is supplied to the low-pressure evaporator 26 via a supply water line 54 connecting the second low-pressure economizer 24 and the low-pressure evaporator 26.

The low-pressure evaporator 26 heats and evaporates the water supplied from the second low-pressure economizer 24 via the supply water line 54 by exchanging heat with the exhaust gas to generate low-pressure steam. A part of the low-pressure steam generated by the low-pressure evaporator 26 is supplied to the low-pressure superheater 28 via a steam line 56 connecting the low-pressure evaporator 26 and the low-pressure superheater 28.

The low-pressure superheater 28 superheats the low-pressure steam supplied from the low-pressure evaporator 26 via the steam line 56 by exchanging heat with the exhaust gas to generate the low-pressure superheated steam. The low-pressure superheated steam generated by the low-pressure superheater 28 flows into the medium-pressure exhaust line 110 via a steam line 58 connecting the low-pressure superheater 28 and the medium-pressure exhaust line 110, and flows from the medium-pressure exhaust line 110 into the steam inlet of the low-pressure steam turbine 106.

A part of the water heated by the second low-pressure economizer 24 is supplied to the medium-pressure economizer 31 via a supply water line 60. The supply water line 60 is provided to branch from the supply water line 54 and is connected to the medium-pressure economizer 31.

The medium-pressure economizer 31 heats the water supplied from the second low-pressure economizer 24 via the supply water line 60 by exchanging heat with the exhaust gas. The water heated by the medium-pressure economizer 31 is supplied to the medium-pressure evaporator 32 via a supply water line 64 connecting the medium-pressure economizer 31 and the medium-pressure evaporator 32.

The medium-pressure evaporator 32 heats and evaporates the water supplied from the medium-pressure economizer 31 via the supply water line 64 by exchanging heat with the exhaust gas to generate medium-pressure steam. A part of the medium-pressure steam generated by the medium-pressure evaporator 32 is supplied to the medium-pressure superheater 34 via a steam line 66 connecting the medium-pressure evaporator 32 and the medium-pressure superheater 34.

The medium-pressure superheater 34 superheats the medium-pressure steam supplied from the medium-pressure evaporator 32 via the steam line 66 by exchanging heat with the exhaust gas to generate the medium-pressure superheated steam. The medium-pressure superheated steam generated by the medium-pressure superheater 34 is supplied to a high-pressure exhaust line 114 connecting a steam outlet of the high-pressure steam turbine 102 and a steam inlet of the first reheater 42 via a steam line 68. The medium-pressure superheated steam generated by the medium-pressure superheater 34 flows into the first reheater 42 via the steam line 68 and the high-pressure exhaust line 114.

A part of the water heated by the second low-pressure economizer 24 is supplied to the first high-pressure economizer 30 via a supply water line 70 connecting the second low-pressure economizer 24 and the first high-pressure economizer 30.

The first high-pressure economizer 30 heats the heated water supplied from the second low-pressure economizer 24 via the supply water line 70 by exchanging heat with the exhaust gas. The heated water heated by the first high-pressure economizer 30 is supplied to the second high-pressure economizer 36 via a supply water line 74 connecting the first high-pressure economizer 30 and the second high-pressure economizer 36.

The second high-pressure economizer 36 heats the high-pressure heated water supplied from the first high-pressure economizer 30 via the supply water line 74 by exchanging heat with the exhaust gas. The high-pressure heated water heated by the second high-pressure economizer 36 is supplied to the high-pressure evaporator 38 via a supply water line 76 connecting the second high-pressure economizer 36 and the high-pressure evaporator 38.

The high-pressure evaporator 38 heats and evaporates the water supplied from the second high-pressure economizer 36 via the supply water line 76 by exchanging heat with the exhaust gas to generate high-pressure steam. The high-pressure steam generated by the high-pressure evaporator 38 is supplied to the first high-pressure superheater 40 via a steam line 78 connecting the high-pressure evaporator 38 and the first high-pressure superheater 40.

The first high-pressure superheater 40 superheats the high-pressure steam supplied from the high-pressure evaporator 38 via the steam line 78 by exchanging heat with the exhaust gas to generate the high-pressure superheated steam. The high-pressure superheated steam generated by the first high-pressure superheater 40 is supplied to the second high-pressure superheater 44 via a steam line 80 connecting the first high-pressure superheater 40 and the second high-pressure superheater 44.

The second high-pressure superheater 44 further superheats the high-pressure superheated steam supplied from the first high-pressure superheater 40 via the steam line 80 by exchanging heat with the exhaust gas. The high-pressure superheated steam superheated by the second high-pressure superheater 44 is supplied to the high-pressure steam turbine 102 via a steam line 97 connecting the second high-pressure superheater 44 and a steam inlet of the high-pressure steam turbine 102.

The first reheater 42 heats the steam supplied from the steam outlet of the high-pressure steam turbine 102 to the first reheater 42 via the high-pressure exhaust line 114 and the steam supplied from the medium-pressure superheater 34 to the first reheater 42 via the steam line 68 and the high-pressure exhaust line 114 by exchanging heat with the exhaust gas. The steam heated by the first reheater 42 is supplied to the second reheater 46 via a steam line 82 connecting the first reheater 42 and the second reheater 46.

The second reheater 46 heats the steam supplied via the steam line 82 by exchanging heat with the exhaust gas. The steam heated by the second reheater 46 is supplied to the medium-pressure steam turbine 104 via a steam line 98 connecting the second reheater 46 and a steam inlet of the medium-pressure steam turbine 104.

As described above, the heat recovery steam generator 5 according to one embodiment is a quadruple-pressure system having a high-pressure system, a medium-pressure system, a low-pressure system, and a super low-pressure system.

Chemical Injection Device

The chemical injection device 150 according to one embodiment is for injecting a chemical for reforming the steam into the low-pressure intermediate-stage steam supply line 57, and includes a chemical tank 151 and a chemical injection pump 153.

The chemical tank 151 is a tank that stores a chemical for reforming steam.

The chemical injection pump 153 is a pump for injecting the chemical in the chemical tank 151 into the low-pressure intermediate-stage steam supply line 57 via a chemical injection line 155.

The chemical injection line 155 is connected to the low-pressure intermediate-stage steam supply line 57.

In the steam turbine system 100A according to one embodiment, the chemical pumped by the chemical injection pump 153 is supplied to a main flow path through which main steam flows inside the low-pressure steam turbine 106, together with the steam flowing through the low-pressure intermediate-stage steam supply line 57.

A mixing unit 157 for mixing the chemical from the chemical injection line 155 and the steam flowing through the low-pressure intermediate-stage steam supply line 57 may be provided at a connecting portion between the chemical injection line 155 and the low-pressure intermediate-stage steam supply line 57.

Chemical for Reforming Steam

Specifically, as the chemical for reforming steam, a volatile amine compound (film-forming amine) having volatility, a surfactant action, and corrosion resistance, or a volatile non-amine compound is suitably used.

Specific examples of volatile amines include long-chain saturated aliphatic amines of monoamines such as dodecylamine, tridecylamine, tetradecylamine, pentadecylamine, hexadecylamine, heptadecylamine, octadecylamine, nonadecilamine, eicosylamine, and docosylamine; long-chain unsaturated aliphatic amines such as oleylamine, lysinorailamine, linoleylamine, and linolenylamine; mixed amines such as coconut oil amine and cured cowfat amine; and mixtures thereof.

Further, a polyamine represented by the following general formula is also suitably used.

R1—[NH—(CH2)m]n-NH2

In the above formula, R1 represents a saturated or unsaturated hydrocarbon having 10 to 22 carbon atoms, m is an integer of 1 to 8, and n is an integer of 1 to 7. In a case where n is 2 or more, a plurality of [NH—(CH2)m]n may be the same or different from each other.

The hydrocarbon group of R1 may be linear or may have a branched chain. Further, the hydrocarbon group may be annular. Specific examples thereof include an alkyl group, an alkenyl group, an alkazienyl group, and an alkynyl group. More preferably, a linear alkyl group or a linear alkenyl group is used, and the number of carbon atoms in this case is 15 to 22. From the viewpoint of suppressing corrosion, m is preferably an integer of 2 to 6. Examples of the (CH2)m group include a methylene group, an ethylene group (dimethylene group), a propylene group (trimethylene group), or a butylene group (tetramethylene group), and a propylene group is more preferable. Further, it is desirable that n is an integer of 1 to 3 from the viewpoint of suppressing corrosion.

Specific examples of such a polyamine include dodecylaminomethyleneamine, dodecylaminodimethyleneamine, dodecylaminotrimethyleneamine (N-stearyl-1,3-propanediamine), and tetradezyl, hexadecyl, and octadecyl compounds corresponding to these polyamines, octadecenylaminotrimethyleneamine, octadecenylamino di-(trimethylamino)-trimethyleneamine, palmitoylaminotrimethyleneamine, and tallow alkyl diamine ethoxylate. It is more desirable to use N-oleyl-1,3-propanediamine (that is, N-octadecenylpropane-3-diamine) which is easily available with sufficient purity. The trade name "Ethiduomine" from Akzo Nobel N.V. can also be suitably used.

As the volatile non-amine compound, polyethylene (20) sorbitan monostearate, sorbitan monostearate, and sorbitan monolaurate are used.

Only one type of these substances may be used as the chemical for reforming steam, or two or more types of these substances may be mixed and used as the chemical for reforming steam.

The steam passing through the steam turbine 101 loses energy from an upstream side to the downstream side, and the temperature and pressure thereof decrease. Therefore, in a turbine stator vane stage close to the most downstream stage of the steam turbine 101 (low-pressure steam turbine 106), a part of the steam is condensed into fine water droplets and exists in the air flow, and a part of the water droplets adheres to a surface of the turbine stator vane. These water droplets quickly grow on a vane surface to form a liquid film. The liquid film is constantly exposed to a high-speed steam flow around the liquid film, but when the liquid film grows further and becomes thicker, a portion of the liquid film is torn by the steam flow and scattered in the form of coarse droplets. The scattered droplets flow toward the downstream side while gradually accelerating due to the steam flow. As a size of the droplets increases, a mass increases. Accordingly, it is difficult for the steam flow to accelerate to steam velocity, and mainstream steam cannot pass between turbine rotor vanes and collides with the turbine rotor vanes. The collision of the droplets may hinder rotation of a turbine rotor vane, resulting in braking loss. In addition, since a peripheral speed of the turbine rotor vane may exceed a speed of sound, when the scattered droplets collide with the turbine rotor vane, the droplets may erode the surface and generate erosion.

Therefore, in the steam turbine system 100 according to one embodiment, the steam turbine system 100 is configured as follows. That is, the steam turbine system 100 according to one embodiment includes the steam turbine 101 (low-pressure steam turbine 106), the main steam supply line (medium-pressure exhaust line 110) for supplying steam to the most upstream stage of the steam turbine 101 (low-pressure steam turbine 106), the intermediate-stage steam supply line (low-pressure intermediate-stage steam supply line 57) for supplying steam to the intermediate stage that is downstream of the most upstream stage of the steam turbine 101 (low-pressure steam turbine 106), and the chemical injection device 150 for injecting a chemical for reforming the steam into the intermediate-stage steam supply line (low-pressure intermediate-stage steam supply line 57).

According to the steam turbine system 100 according to the embodiment, the steam in which the chemical for reforming the steam is added is supplied to the intermediate stage of the steam turbine 101 (low-pressure steam turbine 106). In this manner, in addition to the improvement in efficiency of the steam turbine system 100 by supplying the steam to the intermediate stage, the braking loss as described above can be suppressed by reducing the size of the droplets generated in the steam turbine 101 (low-pressure steam turbine 106). In this manner, the efficiency of the steam turbine system 100 can be improved.

In the steam turbine system 100 according to one embodiment, the steam turbine 101 may include a high-pressure steam turbine 102, a medium-pressure steam turbine 104, and a low-pressure steam turbine 106. The intermediate-stage steam supply line may include a low-pressure intermediate-stage steam supply line 57 for supplying steam to an intermediate stage of the low-pressure steam turbine 106. The chemical injection device 150 may be capable of injecting a chemical into the low-pressure intermediate-stage steam supply line 57.

Accordingly, the steam containing the chemical for reforming the steam is supplied to the intermediate stage or later of the low-pressure steam turbine 106, in which there is a high probability that a part of the steam is condensed and exists in the air flow as fine water droplets, so that the droplets generated in the steam turbine 101 can be efficiently reduced in size.

In the steam turbine system 100 according to one embodiment, the intermediate stage may be the most downstream stage of the steam turbine 101 (low-pressure steam turbine 106) or a stage on a first stage upstream side of the most downstream stage.

Accordingly, the steam containing the chemical for reforming the steam is supplied to the most downstream stage or the stage on the first stage upstream side of the most downstream stage or later, in which there is a high probability that a part of the steam is condensed and exists in the air flow as fine water droplets, so that the droplets generated in the steam turbine 101 (low-pressure steam turbine 106) can be efficiently reduced in size.

In the steam turbine system 100 according to one embodiment, the intermediate-stage steam supply line (low-pressure intermediate-stage steam supply line 57) may be a steam line that is branched from a main steam supply line in which steam or water circulates inside the steam turbine 101 (low-pressure steam turbine 106), the condenser 108, and the heat exchanger 20, for supplying the steam to an upstream stage of the steam turbine 101 (low-pressure steam turbine 106).

Accordingly, the steam can be supplied to the intermediate stage from the steam line that is branched from the main steam supply line in which steam or water circulates inside the steam turbine 101 (low-pressure steam turbine 106), the condenser 108, and the heat exchanger 20, supplying the steam to the upstream stage of the steam turbine 101 (low-pressure steam turbine 106).

In the steam turbine system 100 according to one embodiment, the steam turbine 101 may be configured to be supplied with the steam generated by the steam generator (heat recovery steam generator 5). The steam generator (heat recovery steam generator 5) may include a heat medium flow path (exhaust gas flow path 18) through which a heat medium flows, a first economizer (first low-pressure economizer 22) provided in the heat medium flow path (exhaust gas flow path 18), a second economizer (second low-pressure economizer 24) provided on an upstream side of the first economizer (first low-pressure economizer 22) in a flow direction of the heat medium in the heat medium flow path (exhaust gas flow path 18), a first evaporator (low-pressure evaporator 26) provided on an upstream side of the second economizer (second low-pressure economizer 24) in the flow direction of the heat medium in the heat medium flow path (exhaust gas flow path 18), a first superheater (low-pressure superheater 28) provided on an upstream side of the first evaporator (low-pressure evaporator 26) in the flow direction of the heat medium in the heat medium flow path (exhaust gas flow path 18), a second evaporator (super low-pressure evaporator 121) provided on an upstream side of the first economizer (first low-pressure economizer 22) and on a downstream side of the second economizer (second low-pressure economizer 24) in the flow direction of the heat medium in the heat medium flow path (exhaust gas flow path 18), and a second superheater (super low-pressure superheater 123) provided on an upstream side of the second evaporator (super low-pressure evaporator 121) and on a downstream side of the second economizer (second low-pressure economizer 24) in the flow direction of the heat medium in the heat medium flow path (exhaust gas flow path 18). The main steam supply line (medium-pressure exhaust line 110) may be connected to the first superheater (low-pressure superheater 28). The intermediate-stage steam supply line (low-pressure intermediate-stage steam supply line 57) may be connected to the second superheater (super low-pressure superheater 123).

In this manner, the efficiency of the steam turbine system 100 can be improved by supplying the steam having a pressure lower than the pressure of the main steam supplied to the main steam supply line (medium-pressure exhaust line 110) to the intermediate stage.

Other Embodiments

Figure 2:
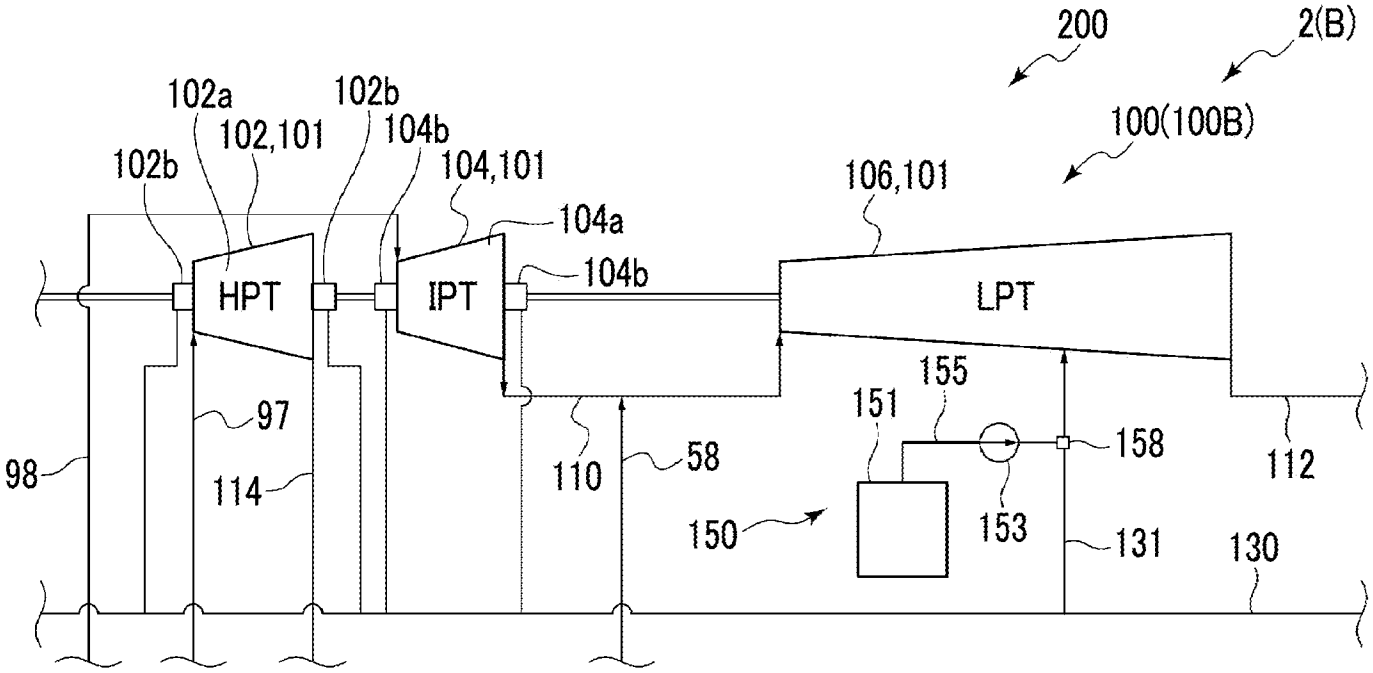
FIG. 2 is a diagram showing a schematic configuration of a part of a combined plant according to another embodiment.

FIG. 2 is a diagram showing a schematic configuration of a part of a combined plant 2 (2B) according to another embodiment.

The combined plant 2B according to another embodiment has the same configuration as the configuration of the combined plant 2A according to one embodiment shown in FIG. 1 except for the following points. In the combined plant 2B according to another embodiment, the same configurations as the configurations of the combined plant 2A according to one embodiment shown in FIG. 1 may be assigned with the same reference numerals s of the combined plant 2A according to one embodiment, and detailed description thereof may be omitted.

Although the illustration is omitted in the drawing in FIG. 1 in order to avoid complication of the drawing, the steam turbine system 100A according to one embodiment shown in FIG. 1 and the steam turbine system 100 (100B) according to another embodiment shown in FIG. 2 include a gland steam supply line 130 for guiding the steam to a high-pressure gland portion 102*b* that reduces steam leakage from a turbine body 102*a* of the high-pressure steam turbine 102 to the outside and to a medium-pressure gland portion 104*b* that reduces steam leakage from a turbine body 104*a* of the medium-pressure steam turbine 104 to the outside.

In the steam turbine system 100B according to another embodiment, unlike in the steam turbine system 100A according to one embodiment shown in FIG. 1, the steam turbine system 100B has a branch line 131 (intermediate-stage steam supply line) that is provided to branch from the gland steam supply line 130. The branch line 131 connects the gland steam supply line 130 and an intermediate stage of the low-pressure steam turbine 106. Therefore, a part of the steam flowing through the gland steam supply line 130 is supplied to the intermediate stage of the low-pressure steam turbine 106 via the branch line 131.

In the steam turbine system 100B according to another embodiment, unlike in the steam turbine system 100A according to one embodiment shown in FIG. 1, the chemical injection device 150 is configured to inject the chemical in the chemical tank 151 into the branch line 131 via the chemical injection line 155. That is, in the steam turbine system 100B according to another embodiment, unlike in the steam turbine system 100A according to one embodiment shown in FIG. 1, the chemical injection line 155 is connected to the branch line 131.

In the steam turbine system 100B according to another embodiment, the chemical pumped by the chemical injection pump 153 is supplied to the main flow path through which the main steam flows inside the low-pressure steam turbine 106, together with the steam flowing through the branch line 131.

A mixing unit 158 for mixing the chemical from the chemical injection line 155 and the steam flowing through the branch line 131 may be provided at a connecting portion between the chemical injection line 155 and the branch line 131.

In the steam turbine system 100B according to another embodiment, the intermediate-stage steam supply line (branch line 131) may be configured to supply the steam extracted from a device other than the low-pressure steam turbine 106.

Accordingly, the steam extracted from the device other than the low-pressure steam turbine 106 can be supplied to the intermediate stage of the low-pressure steam turbine 106.

The device other than the low-pressure steam turbine 106 is, for example, an auxiliary boiler (not shown) of the combined plant 2, when gland steam supplied to the high-pressure gland portion 102*b* or the medium-pressure gland portion 104*b* is the steam from the auxiliary boiler. In addition, the device other than the low-pressure steam turbine 106 is, for example, the high-pressure steam turbine 102 or the medium-pressure steam turbine 104, when the gland steam supplied to the high-pressure gland portion 102*b* or the medium-pressure gland portion 104*b* is the steam that is bled from the high-pressure steam turbine 102 or the medium-pressure steam turbine 104.

As described above, in the steam turbine system 100B according to another embodiment, the branch line 131 (intermediate-stage steam supply line) is branched from the gland steam supply line 130, and is configured to supply the steam from the gland steam supply line 130 to the intermediate stage of the low-pressure steam turbine 106.

Accordingly, the efficiency of the steam turbine system 100B can be improved by supplying the steam of the gland steam supply line 130 to the intermediate stage of the low-pressure steam turbine 106.

In steam turbine system 100B according to another embodiment, the heat recovery steam generator 5 may be a triple-pressure system having a high-pressure system, a medium-pressure system, and a low-pressure system.

In addition, in the steam turbine system 100B according to another embodiment, the heat recovery steam generator 5 may be a quadruple-pressure system having a high-pressure system, a medium-pressure system, a low-pressure system, and a super low-pressure system. In this case, in the steam turbine system 100B according to another embodiment, unlike in the steam turbine system 100A according to one embodiment shown in FIG. 1, the chemical injection device 150 may be configured to inject the chemical in the chemical tank 151 into the branch line 131 via the chemical injection line 155.

The present disclosure is not limited to the above-described embodiments, and includes a modification of the above-described embodiments and an appropriate combination of the embodiments.

For example, the heat recovery steam generator 5 according to the above-described embodiment is a quadruple-pressure system having a high-pressure system, a medium-pressure system, a low-pressure system, and a super low-pressure system, but may be a single-pressure system, a double-pressure system, or a triple-pressure system.

Similarly, the heat recovery steam generator 5 according to another embodiment described above may be a single-pressure system or a double-pressure system in addition to the triple-pressure system or the quadruple-pressure system described above.

In a case where the heat recovery steam generator 5 according to some embodiments described above is a dual-pressure system, the chemical injection device 150 may be configured to inject the chemical into an intermediate stage of the steam turbine 101 that is most downstream.

In some embodiments described above, the chemical pumped by the chemical injection pump 153 is supplied to the main flow path in which the main steam flows inside the low-pressure steam turbine 106, together with the steam flowing through the low-pressure intermediate-stage steam supply line 57 or the steam flowing through the branch line 131.

However, as will be described below, the chemical pumped by the chemical injection pump 153 may be directly supplied to the inside of the stator vane of the steam turbine 101 (low-pressure steam turbine 106) and may be supplied from the surface of the stator vane to a main flow path in which the main steam flowing through the steam turbine 101 (low-pressure steam turbine 106).

Figure 3A:
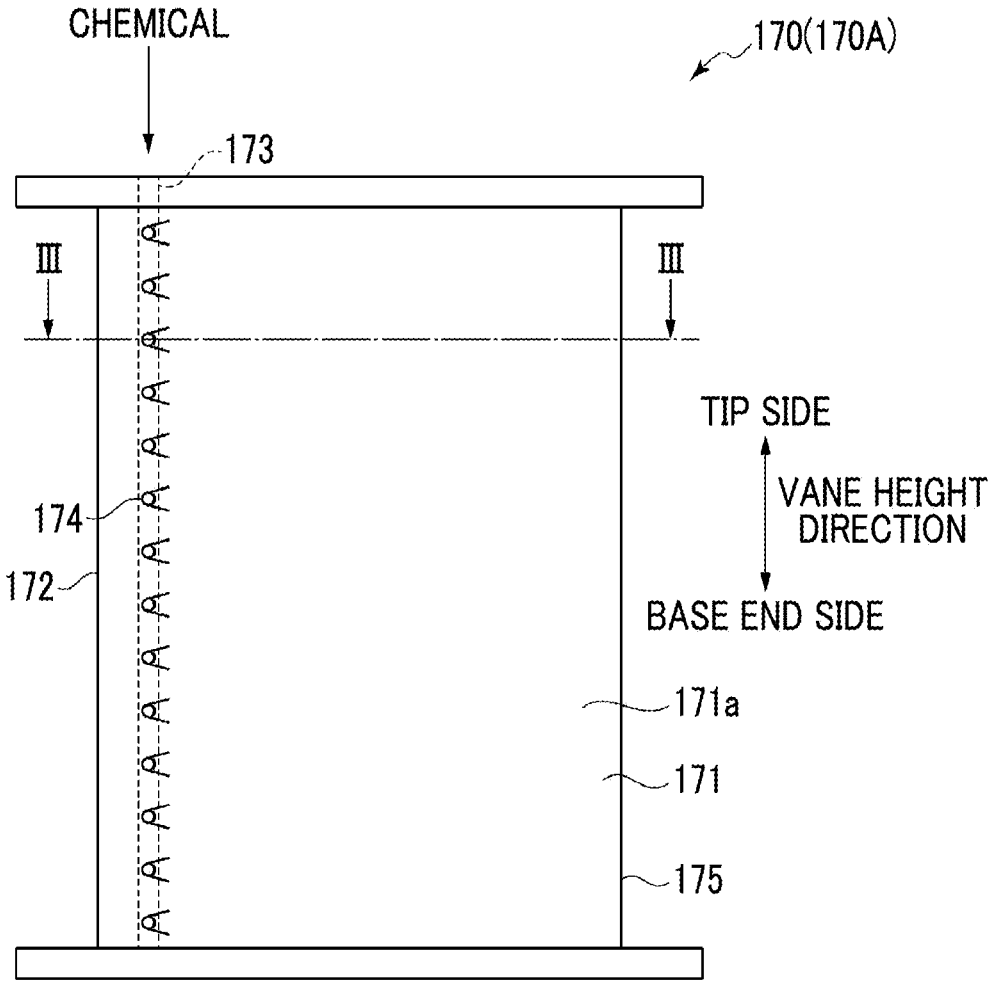
FIG. 3A is a schematic side view of a stator vane of a steam turbine.

FIG. 3A is a schematic side view of a stator vane 170 (170A) of the steam turbine 101 (low-pressure steam turbine 106).

Figure 3B:
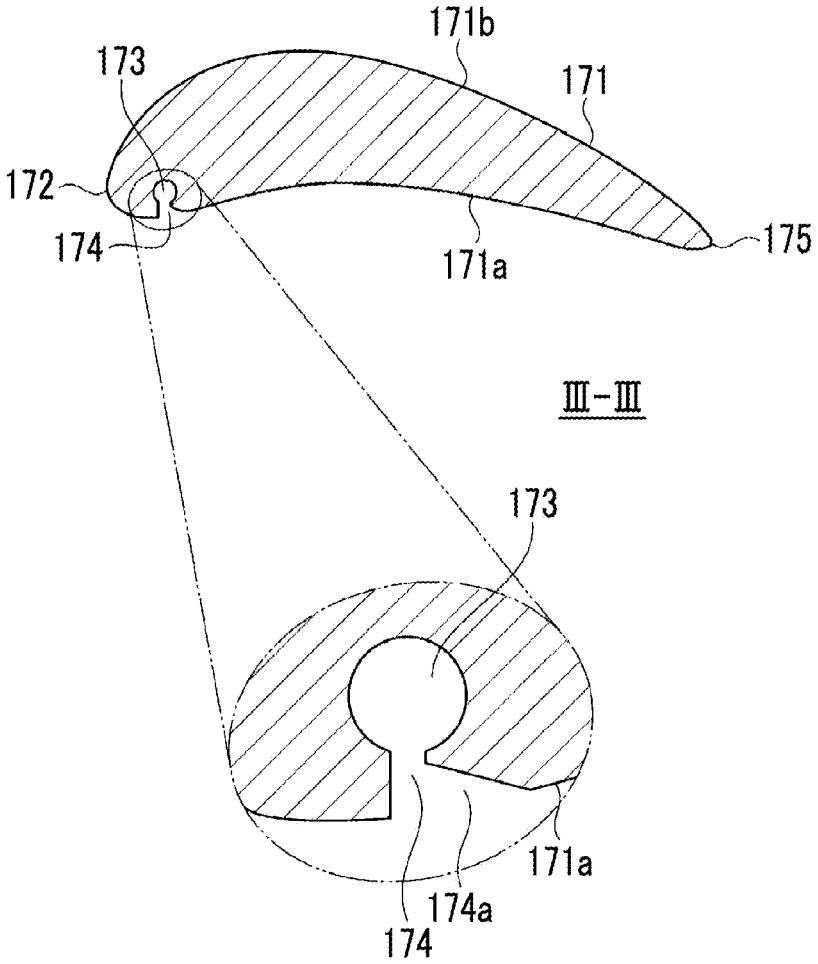
FIG. 3B is a schematic view showing a cross section taken along line III-III of FIG. 3A.

FIG. 3B is a schematic view showing a cross section taken along line III-III of FIG. 3A.

In the stator vane 170A shown in FIGS. 3A and 3B, a circulation hole 173 for the chemical is provided in an airfoil portion 171 from a base end to a tip of the airfoil portion 171 over the entire portion in a vane height direction.

In the stator vane 170A shown in FIGS. 3A and 3B, the circulation hole 173 is formed in the vicinity of a pressure surface 171*a* and in the vicinity of a leading edge 172 of the airfoil portion 171.

In the stator vane 170A shown in FIGS. 3A and 3B, a plurality of through-holes 174 communicating with the circulation hole 173 are formed on the pressure surface 171*a* side in the vicinity of the leading edge 172 in the pressure surface 171*a* along an extending direction of the circulation hole 173 over the entire vane height direction.

An opening 174*a* of the plurality of through-holes 174 on an outlet side (the surface of the vane) may be formed such that the width along the vane height direction gradually increases toward a trailing edge 175 side.

The circulation hole 173 and the plurality of through-holes 174 may be provided in all the stator vanes 170 in any stage of the intermediate stages or the most downstream stage of the steam turbine 101 (low-pressure steam turbine 106).

In the stator vane 170A shown in FIGS. 3A and 3B, the configuration may be made such that the chemical pumped by the chemical injection pump 153 is directly supplied to the circulation hole 173. The supply flow rate of the chemical can be controlled by regulating the supply pressure to the circulation hole 173.

Figure 4A:
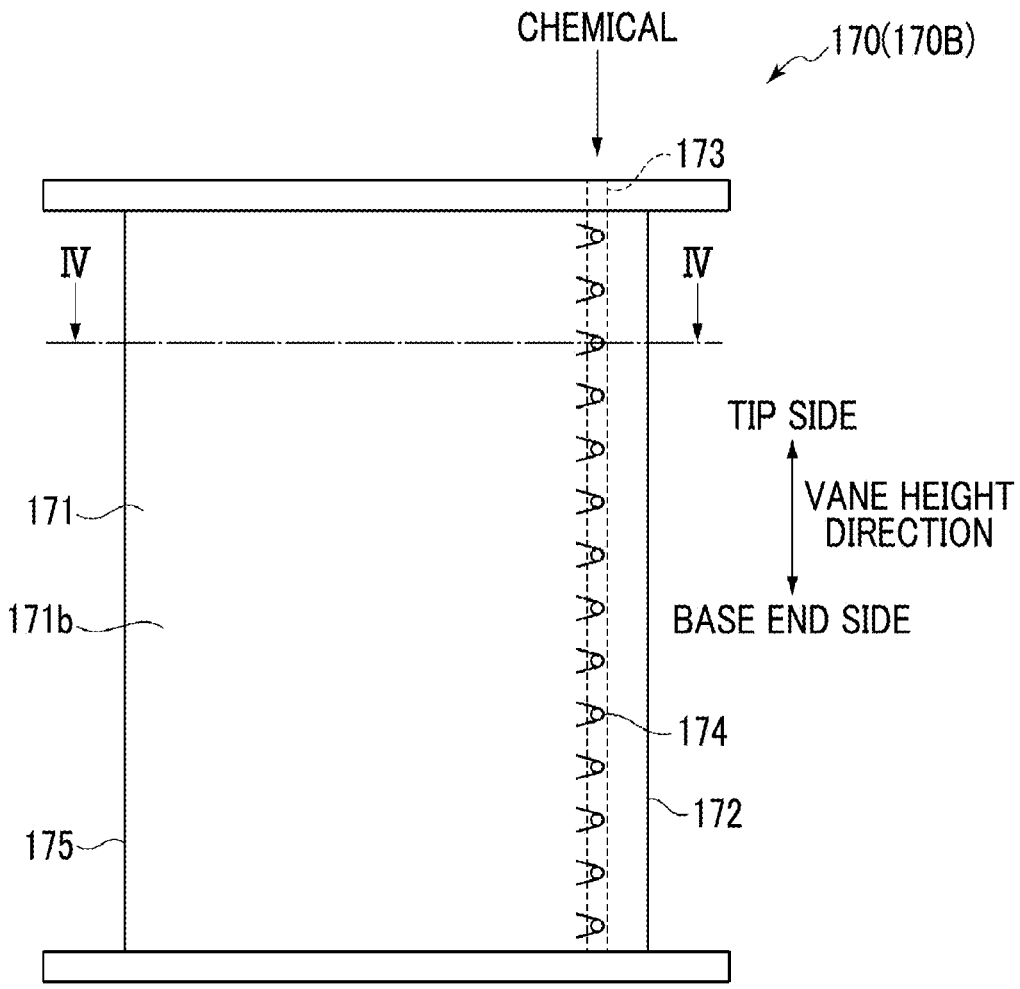
FIG. 4A is a schematic side view of the stator vane of the steam turbine.

FIG. 4A is a schematic side view of the stator vane 170 (170B) of the steam turbine 101 (low-pressure steam turbine 106).

Figure 4B:
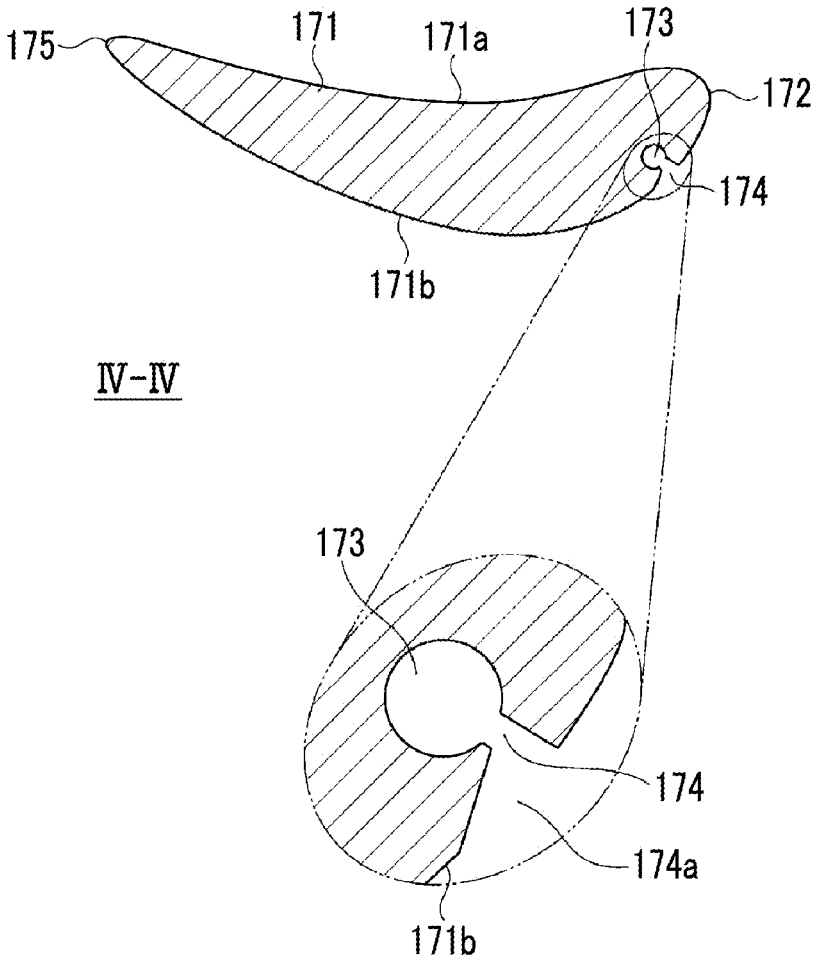
FIG. 4B is a schematic view showing a cross section taken along line IV-IV of FIG. 4A.

FIG. 4B is a schematic view showing a cross section taken along line IV-IV of FIG. 4A.

As in the stator vane 170B shown in FIGS. 4A and 4B, the circulation hole 173 and the plurality of through-holes 174 may be formed in the vicinity of a suction surface 171*b* of the airfoil portion 171 and in the vicinity of the leading edge 172.

Figure 5:
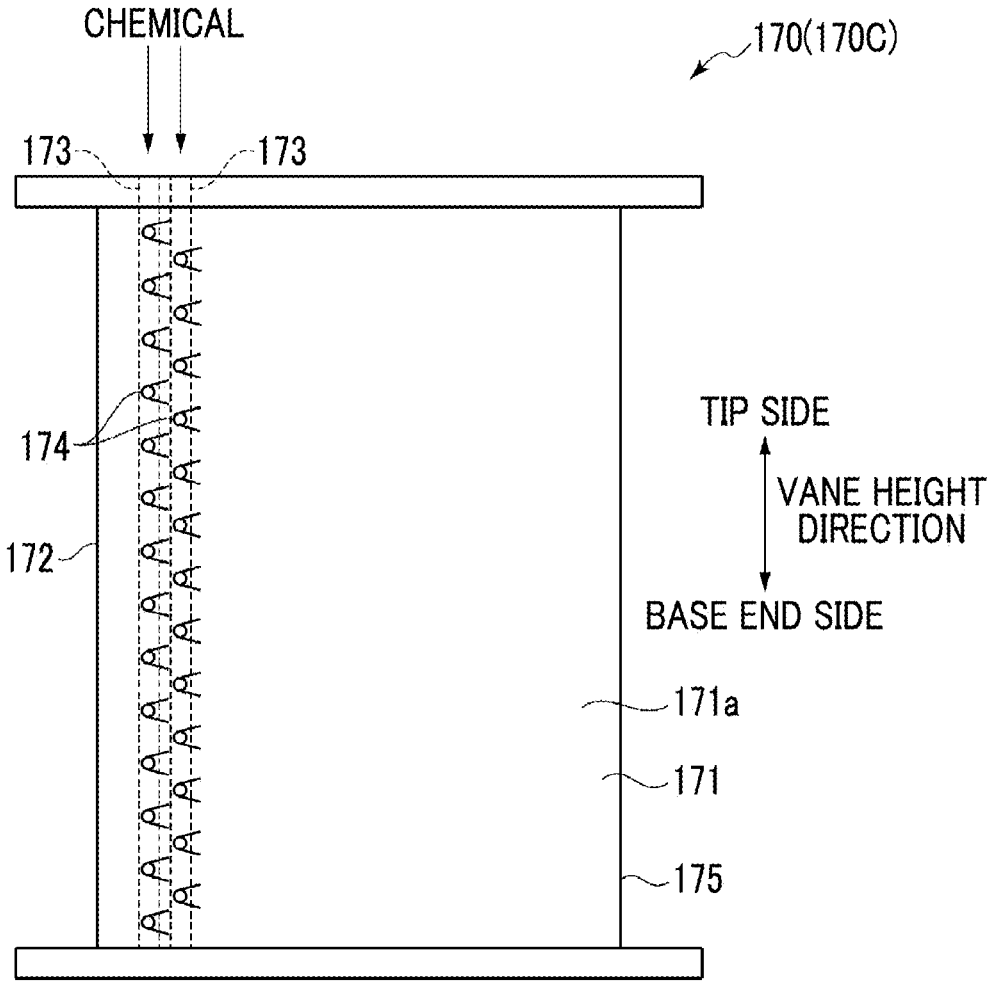
FIG. 5 is a schematic side view of the stator vane of the steam turbine.

FIG. 5 is a schematic side view of the stator vane 170 (170C) of the steam turbine 101 (low-pressure steam turbine 106).

In the stator vane 170A shown in FIGS. 3A and 3B or the stator vane 170B shown in FIGS. 4A and 4B, the circulation hole 173 and the plurality of through-holes 174 may be disposed in a plurality of rows in which positions along the flow direction of the steam are different, as in the stator vane 170C shown in FIG. 5. In this case, the positions of the plurality of through-holes 174 adjacent to each other in the flow direction of the steam in the vane height direction may be different from each other.

Figure 6A:
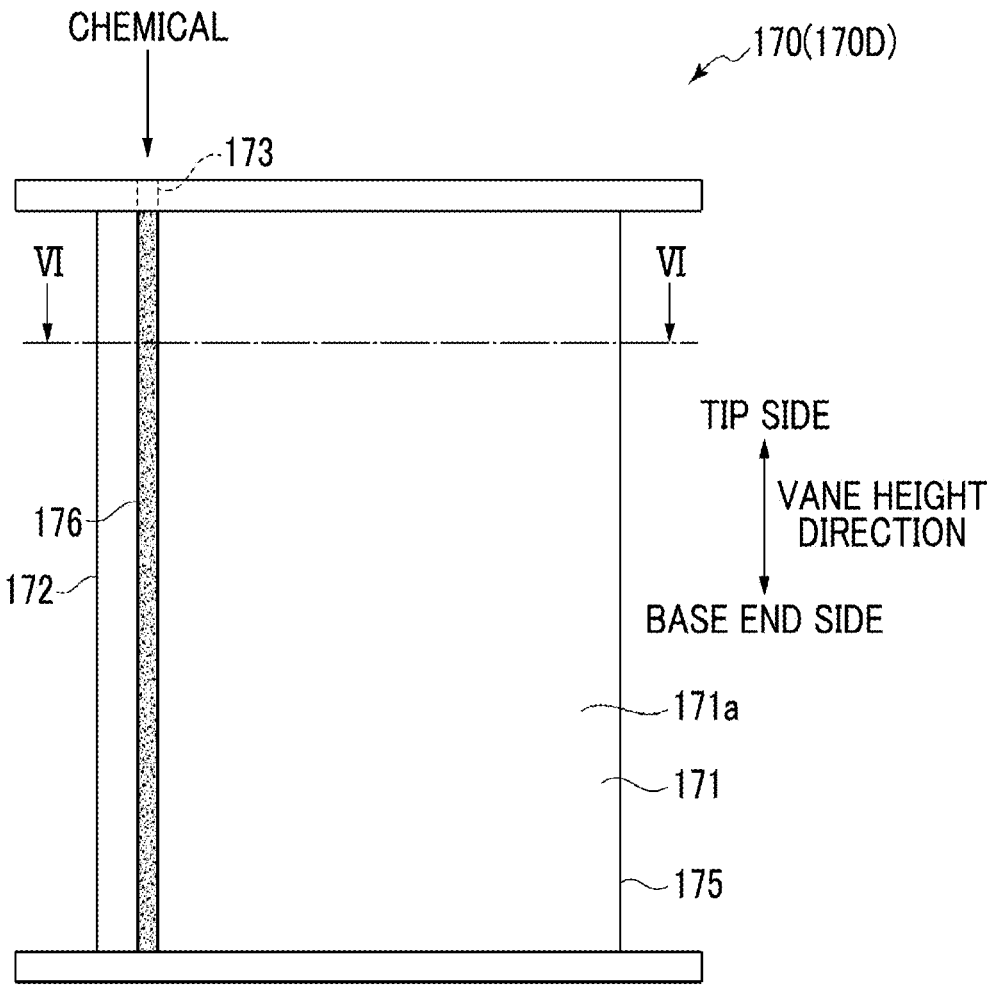
FIG. 6A is a schematic side view of the stator vane of the steam turbine.

FIG. 6A is a schematic side view of the stator vane 170 (170D) of the steam turbine 101 (low-pressure steam turbine 106).

Figure 6B:
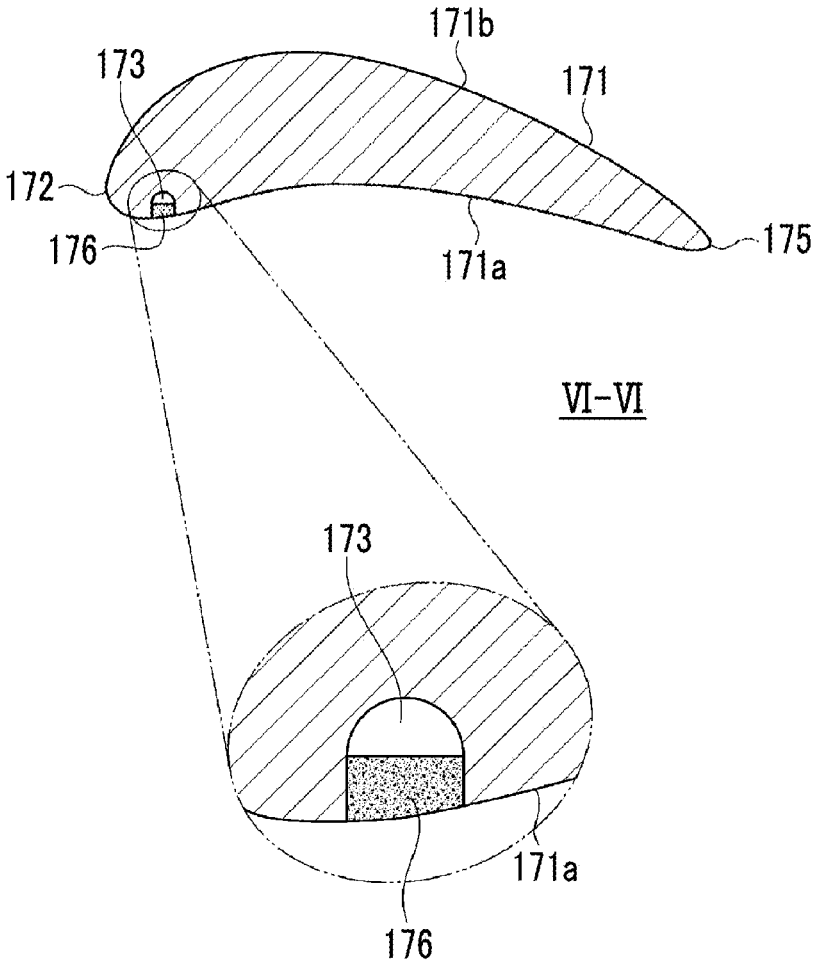
FIG. 6B is a schematic view showing a cross section taken along line VI-VI of FIG. 6A.

FIG. 6B is a schematic view showing a cross section taken along line VI-VI of FIG. 6A.

In the stator vane 170D shown in FIGS. 6A and 6B, the chemical can be supplied from the circulation hole 173 to the main flow path inside the steam turbine 101 (low-pressure steam turbine 106) via a porous body 176.

The porous body 176 may extend over the entire airfoil portion 171 from the base end to the tip in the vane height direction.

The porous body 176 can be formed by a lay-up forming method or the like.

In the stator vane 170 shown in FIGS. 3A, 3B, 4A, 4B, and 5, the chemical may be supplied via the porous body 176 instead of being supplied from the plurality of through-holes 174 to the main flow path inside the steam turbine 101 (low-pressure steam turbine 106).

The contents described in each embodiment are understood as follows, for example.

(1) The steam turbine system 100 according to at least one embodiment of the present disclosure includes the steam turbine 101 (low-pressure steam turbine 106), the main steam supply line (medium-pressure exhaust line 110) for supplying steam to the most upstream stage of the steam turbine 101 (low-pressure steam turbine 106), the intermediate-stage steam supply line (low-pressure intermediate-stage steam supply line 57 and branch line 131) for supplying steam to the intermediate stage that is downstream of the most upstream stage of the steam turbine 101 (low-pressure steam turbine 106), and the chemical injection device 150 for injecting a chemical for reforming the steam into the intermediate-stage steam supply line (low-pressure intermediate-stage steam supply line 57 and branch line 131).

According to the configuration of (1), the steam in which the chemical for reforming the steam is added is supplied to the intermediate stage of the steam turbine 101 (low-pressure steam turbine 106). In this manner, in addition to the improvement in the efficiency of the steam turbine system 100 by supplying the steam to the intermediate stage, the braking loss as described above can be suppressed by reducing the size of the droplets generated in the steam turbine 101 (low-pressure steam turbine 106). In this manner, the efficiency of the steam turbine system 100 can be improved.

(2) In some embodiments, according to the configuration of (1), the steam turbine 101 may include a high-pressure steam turbine 102, a medium-pressure steam turbine 104, and a low-pressure steam turbine 106. The intermediate-stage steam supply line may include a low-pressure intermediate-stage steam supply line 57 for supplying steam to an intermediate stage of the low-pressure steam turbine 106. The chemical injection device 150 may be capable of injecting a chemical into the low-pressure intermediate-stage steam supply line 57.

According to the configuration of (2), the steam containing the chemical for reforming the steam is supplied to the intermediate stage or later of the low-pressure steam turbine 106, in which there is a high probability that a part of the steam is condensed and exists in the air flow as water droplets, so that the fine droplets generated in the low-pressure steam turbine 106 can be efficiently reduced in size.

(3) In some embodiments, according to the configuration of (1) or (2), the intermediate stage may be the most downstream stage of the steam turbine (low-pressure steam turbine 106) or a stage on a first stage upstream side of the most downstream stage.

According to the configuration of (3), the steam containing the chemical for reforming the steam is supplied to the most downstream stage or the stage on the first stage upstream side of the most downstream stage or later, in which there is a high probability that a part of the steam is condensed and exists in the air flow as water droplets, so that the fine droplets generated in the steam turbine (low-pressure steam turbine 106) can be efficiently reduced in size.

(4) In some embodiments, according to any one of the configurations of (1) to (3), the intermediate-stage steam supply line (low-pressure intermediate-stage steam supply line 57) may be a steam line that is branched from a main steam supply line in which steam or water circulates inside the steam turbine 101 (low-pressure steam turbine 106), the condenser 108, and the heat exchanger 20, for supplying the steam to an upstream stage of the steam turbine 101 (low-pressure steam turbine 106).

According to the configuration of (4), the steam can be supplied to the intermediate stage from the steam line that is branched from the main steam supply line in which steam or water circulates inside the steam turbine 101 (low-pressure steam turbine 106), the condenser 108, and the heat exchanger 20, for supplying the steam to the upstream stage of the steam turbine 101 (low-pressure steam turbine 106).

(5) In some embodiments, according to any one of the configurations of (1) to (4), the steam turbine 101 may be configured to be supplied with the steam generated by the steam generator (heat recovery steam generator 5). The steam generator (heat recovery steam generator 5) may include a heat medium flow path (exhaust gas flow path 18) through which an exhaust gas of a gas turbine 4 flows as a heat medium, a first economizer (first low-pressure economizer 22) provided in the heat medium flow path (exhaust gas flow path 18), a second economizer (second low-pressure economizer 24) provided on an upstream side of the first economizer (first low-pressure economizer 22) in a flow direction of the heat medium in the heat medium flow path (exhaust gas flow path 18), a first evaporator (low-pressure evaporator 26) provided on an upstream side of the second economizer (second low-pressure economizer 24) in the flow direction of the heat medium in the heat medium flow path (exhaust gas flow path 18), a first superheater (low-pressure superheater 28) provided on an upstream side of the first evaporator (low-pressure evaporator 26) in the flow direction of the heat medium in the heat medium flow path (exhaust gas flow path 18), a second evaporator (super low-pressure evaporator 121) provided on an upstream side of the first economizer (first low-pressure economizer 22) and on a downstream side of the second economizer (second low-pressure economizer 24) in the flow direction of the heat medium in the heat medium flow path (exhaust gas flow path 18), and a second superheater (super low-pressure superheater 123) provided on an upstream side of the second evaporator (super low-pressure evaporator 121) and on a downstream side of the second economizer (second low-pressure economizer 24) in the flow direction of the heat medium in the heat medium flow path (exhaust gas flow path 18). The main steam supply line (medium-pressure exhaust line 110) may be connected to the first superheater (low-pressure superheater 28). The intermediate-stage steam supply line (low-pressure intermediate-stage steam supply line 57) may be connected to the second superheater (super low-pressure superheater 123).

According to the configuration of (5), the efficiency of the steam turbine system 100 can be improved by supplying the steam having a pressure lower than the pressure of the main steam supplied to the main steam supply line (medium-pressure exhaust line 110) to the intermediate stage.

(6) In some embodiments, according to any one of the configurations of (1) to (3), the steam turbine 101 may include a high-pressure steam turbine 102, a medium-pressure steam turbine 104, and a low-pressure steam turbine 106. According to some embodiments, the intermediate-stage steam supply line (branch line 131) may be configured to supply the steam extracted from the device other than the low-pressure steam turbine 106.

According to the configuration of (6), the steam extracted from the device other than the low-pressure steam turbine 106 can be supplied to the intermediate stage.

(7) In some embodiments, according to any one of the configurations of (1) to (6), the steam turbine 101 may include a high-pressure steam turbine 102, a medium-pressure steam turbine 104, and a low-pressure steam turbine 106. In some embodiments, the steam turbine system 100 may include the gland steam supply line 130 for guiding the steam to the high-pressure gland portion 102*b* that reduces the steam leakage from the turbine body 102*a* of the high-pressure steam turbine 102 to the outside and to the medium-pressure gland portion 104*b* that reduces the steam leakage from the turbine body 104*a* of the medium-pressure steam turbine 104 to the outside. The intermediate-stage steam supply line (branch line 131) may be branched from the gland steam supply line 130, and may be configured to supply the steam from the gland steam supply line 130 to the intermediate stage of the low-pressure steam turbine 106.

According to the configuration of (7), the efficiency of the steam turbine system 100 can be improved by supplying the steam of the gland steam supply line 130 to the intermediate stage of the low-pressure steam turbine 106.

REFERENCE SIGNS LIST

2 (2A, 2B): Combined plant
5: Heat recovery steam generator
18: Exhaust gas flow path (heat medium flow path)
22: First low-pressure economizer (first economizer)
24: Second low-pressure economizer (second economizer)
26: Low-pressure evaporator (first evaporator)
28: Low-pressure superheater (first superheater)
57: Low-pressure intermediate-stage steam supply line (intermediate-stage steam supply line)
100 (100A, 100B): Steam turbine system
101: Steam turbine
102: High-pressure steam turbine
104: Medium-pressure steam turbine
106: Low-pressure steam turbine
110: Medium-pressure exhaust line
121: Super low-pressure evaporator (second evaporator)
123: Super low-pressure superheater (second superheater)
131: Branch line (intermediate-stage steam supply line)
150: Chemical injection device
200: Heat recovery plant

The invention claimed is:

1. A steam turbine system comprising: a plurality of steam turbines;

a main steam supply line for supplying steam to a steam inlet of a most downstream steam turbine of the plurality of steam turbines;

an intermediate-stage steam supply line for supplying steam to an intermediate stage of the most downstream steam turbine, the intermediate-stage steam supply line being disposed separately from the main steam supply line; and a chemical injection device for injecting a chemical for reforming steam into the intermediate-stage steam supply line so that the steam in which the chemical for reforming the steam is added is supplied to the intermediate-stage via the intermediate-stage steam supply line.

2. The steam turbine system according to claim 1, wherein the plurality of steam turbines include a high-pressure steam turbine, a medium-pressure steam turbine, and a low-pressure steam turbine, the intermediate-stage steam supply line includes a low-pressure intermediate-stage steam supply line for supplying steam to the intermediate stage of the low-pressure steam turbine, and the chemical injection device is capable of injecting the chemical into the low-pressure intermediate-stage steam supply line.

3. The steam turbine system according to claim 1, wherein the intermediate stage is a most downstream stage of the most downstream steam turbine or a stage on a first stage upstream side of the most downstream stage.

4. The steam turbine system according to claim 1, wherein the intermediate-stage steam supply line is branched from the main steam supply line.

5. The steam turbine system according to claim 1, wherein the plurality of steam turbines is configured to be supplied with steam generated by a steam generator, the steam generator includes a heat medium flow path through which a heat medium flows, a first economizer provided in the heat medium flow path, a second economizer provided on an upstream side of the first economizer in a flow direction of the heat medium in the heat medium flow path, a first evaporator provided on an upstream side of the second economizer in the flow direction of the heat medium in the heat medium flow path, a first superheater provided on an upstream side of the first evaporator in the flow direction of the heat medium in the heat medium flow path, a second evaporator provided on the upstream side of the first economizer and on a downstream side of the second economizer in the flow direction of the heat medium in the heat medium flow path, and a second superheater provided on an upstream side of the second evaporator and on the downstream side of the second economizer in the flow direction of the heat medium in the heat medium flow path, the main steam supply line is connected to the first superheater, and the intermediate-stage steam supply line is connected to the second superheater.

6. The steam turbine system according to claim 1, wherein the plurality of steam turbines include a high-pressure steam turbine, a medium-pressure steam turbine, and a low-pressure steam turbine, and the intermediate-stage steam supply line supplies steam extracted from a device other than the low-pressure steam turbine.

7. The steam turbine system according to claim 1, wherein the plurality of steam turbines include a high-pressure steam turbine, a medium-pressure steam turbine, and a low-pressure steam turbine, the steam turbine system comprises a gland steam supply line for guiding steam to a high-pressure gland portion that reduces steam leakage from a turbine body of the high-pressure steam turbine to an outside and to a medium-pressure gland portion that reduces steam leakage from a turbine body of the medium-pressure steam turbine to an outside, and the intermediate-stage steam supply line is branched from the gland steam supply line and configured to supply steam from the gland steam supply line to the intermediate stage of the low-pressure steam turbine.

8. The steam turbine system according to claim 1, wherein the plurality of steam turbines include a high-pressure steam turbine, a medium-pressure steam turbine, and a low-pressure steam turbine, and the most downstream steam turbine is the low-pressure steam turbine.

* * * * *